US010617213B2

(12) United States Patent
Tang

(10) Patent No.: US 10,617,213 B2
(45) Date of Patent: Apr. 14, 2020

(54) FOLDING STORAGE STOOL

(71) Applicant: WUXI HOUSETEX INDUSTRIES CO., LTD, Wuxi (CN)

(72) Inventor: Hongyan Tang, Wuxi (CN)

( * ) Notice: Subject to any disclaimer, the term of this patent is extended or adjusted under 35 U.S.C. 154(b) by 193 days.

(21) Appl. No.: 15/682,668

(22) Filed: Aug. 22, 2017

(65) Prior Publication Data

US 2017/0347800 A1 Dec. 7, 2017

Related U.S. Application Data

(63) Continuation of application No. PCT/CN2016/088354, filed on Jul. 4, 2016.

(30) Foreign Application Priority Data

Jun. 1, 2016 (CN) ..... 2016 2 0525200 U

(51) Int. Cl.

| | |
|---|---|
| ***A47C 5/00*** | (2006.01) |
| ***A47C 4/52*** | (2006.01) |
| ***A47C 4/02*** | (2006.01) |
| ***A47C 4/28*** | (2006.01) |

(52) U.S. Cl.

CPC ..... *A47C 4/52* (2013.01); *A47C 4/028* (2013.01); *A47C 4/283* (2013.01)

(58) Field of Classification Search

CPC ..... A47C 4/52; A47C 4/028; A47C 4/283; A47C 4/286; A47C 4/04; A47C 4/021; A47C 5/005; A47C 13/00; A47C 13/005; A47C 16/02; B65D 21/086

See application file for complete search history.

(56) References Cited

U.S. PATENT DOCUMENTS

| | | | | | |
|---|---|---|---|---|---|
| 968,633 | A * | 8/1910 | Andrews | B65D 21/086 | 190/105 |
| 1,080,551 | A * | 12/1913 | Hartwell | A01K 97/04 | 220/324 |
| 2,271,962 | A * | 2/1942 | Weiner | B65D 5/4283 | 229/110 |
| 2,592,912 | A * | 4/1952 | Knipper | A47C 12/02 | 182/33 |
| 2,895,541 | A * | 7/1959 | Stanley | A47C 5/005 | 220/560.15 |
| 3,097,016 | A * | 7/1963 | Bigler, Jr. | A47C 5/005 | 297/440.12 |
| 3,126,140 | A * | 3/1964 | Lizan | A47C 5/005 | 108/115 |
| 3,179,278 | A * | 4/1965 | Cohen | B65D 21/086 | 206/527 |

(Continued)

*Primary Examiner* — Kyle J. Walraed-Sullivan
(74) *Attorney, Agent, or Firm* — Erson IP (Nelson IP)

(57) ABSTRACT

Provided is a folding storage stool which comprises a foldable stool body, a stool cover, and a supporting board. The stool body comprises an inner cavity and an upper opening; the upper opening allows the inner cavity in communication with outside. The stool cover is located upon the stool body and covers the upper opening. The supporting board is located at a bottom of the inner cavity and support the foldable stool body to maintain an unfolded state. The stool cover comprises a first cover part and a second cover part. A pivot end of the first cover part is pivotably connected to the second part, and a free end of the first cover part is capable of being pivotable away from the upper opening.

2 Claims, 4 Drawing Sheets

(56) References Cited

U.S. PATENT DOCUMENTS 3,224,661 A * 12/1965 Webster, Jr. ..... B42F 7/08 229/72
3,232,252 A * 2/1966 Nelson ..... A47C 5/005 108/115
3,532,378 A * 10/1970 Dalia ..... A45C 9/00 190/8
3,565,325 A * 2/1971 Pugsley ..... B65D 5/3628 229/117.05
3,606,459 A * 9/1971 Krone ..... A47C 5/005 297/440.12
3,627,086 A * 12/1971 Caigan ..... A47C 1/146 190/8
3,703,159 A * 11/1972 Rose-Miller ..... A01K 1/0236 119/496
3,837,719 A * 9/1974 Barron ..... A47B 3/00 108/115
3,892,441 A * 7/1975 Roeshman ..... A47C 5/005 297/423.41
4,085,970 A * 4/1978 Klein ..... A47C 5/005 297/440.12
4,138,951 A * 2/1979 Nelson ..... A47B 3/00 108/115
4,143,695 A * 3/1979 Hoehn ..... A45C 11/20 220/215
4,556,253 A * 12/1985 Geneve ..... A47C 5/005 248/174
4,569,564 A * 2/1986 Ahmann ..... A47B 23/044 108/34
4,630,861 A * 12/1986 Henschel ..... A47C 4/08 108/124
4,654,907 A * 4/1987 Haugaard ..... A45C 3/10 297/17
4,723,693 A * 2/1988 Decoster ..... B65D 47/0876 220/838
4,742,900 A * 5/1988 Boxhammer ..... A47C 17/82 190/2
4,750,402 A * 6/1988 Markey ..... G10G 7/005 108/90
4,813,744 A * 3/1989 Scalisi ..... A47C 5/005 297/440.12
5,018,454 A * 5/1991 Negus ..... A47B 3/06 108/150
5,064,088 A * 11/1991 Steffes ..... A45C 11/20 220/837
5,190,152 A * 3/1993 Smith ..... B42F 15/0094 206/425
5,402,738 A * 4/1995 Carr ..... A47F 5/10 108/157.1
5,622,404 A * 4/1997 Menne ..... A47C 4/52 297/188.1
5,833,333 A * 11/1998 Brown ..... A47B 83/00 312/235.1
5,944,379 A * 8/1999 Yates ..... A47C 7/021 297/129
5,971,231 A * 10/1999 Samz ..... B65D 21/0219 222/480
6,048,032 A * 4/2000 Stewart ..... A47C 5/005 248/174
6,050,410 A * 4/2000 Quirion ..... B65D 19/20 206/386
6,161,901 A * 12/2000 Avner ..... A47C 5/005 108/165
6,174,026 B1 * 1/2001 Wise ..... A47B 85/00 108/17
6,341,817 B1 * 1/2002 Stern-Gonzalez ..... A47C 3/16 297/188.09
7,025,221 B2 * 4/2006 Kim ..... B65D 21/086 220/324
D543,030 S * 5/2007 Schafer ..... D3/272
7,581,786 B1 * 9/2009 Wang ..... A47B 83/00 297/188.11
7,996,930 B2 * 8/2011 Carter ..... A47K 11/06 220/495.11
8,141,956 B2 * 3/2012 Schouten ..... A47C 4/04 297/440.12
8,205,935 B2 * 6/2012 Tang ..... A47C 3/16 297/17
8,240,770 B2 * 8/2012 Bertele ..... A47B 43/02 297/440.12
8,733,585 B2 * 5/2014 Abdi ..... B65D 25/287 220/254.6
9,051,083 B1 * 6/2015 Davis ..... B65D 25/06
9,226,586 B1 * 1/2016 Reid ..... A47C 7/748
9,308,149 B1 * 4/2016 Niskey, Jr. ..... A61J 1/03
9,809,356 B2 * 11/2017 Kissner ..... B65D 43/169
9,974,391 B2 * 5/2018 Wan ..... A47C 7/62
2001/0004088 A1 * 6/2001 Lau ..... B65D 5/2033 229/117.15
2006/0006702 A1 * 1/2006 Starna ..... A47C 4/52 297/16.1
2006/0124643 A1 * 6/2006 Markert ..... B65D 43/161 220/254.3
2006/0151512 A1 * 7/2006 Van Heugten ..... B65D 43/161 220/826
2007/0045311 A1 * 3/2007 Wang ..... B65D 11/186 220/9.1
2008/0157582 A1 * 7/2008 Bertele ..... A47B 43/02 297/440.12
2008/0190951 A1 * 8/2008 Gallagher ..... B65D 21/0233 220/826
2008/0265631 A1 * 10/2008 Quicoy ..... A47C 16/02 297/42
2009/0251034 A1 * 10/2009 Nielsen ..... A47B 43/02 312/259
2009/0261643 A1 * 10/2009 Kay ..... A47C 4/20 297/335
2010/0146703 A1 * 6/2010 Higgs ..... A47C 7/62 5/503.1
2010/0244501 A1 * 9/2010 Chiang ..... A47C 3/16 297/118
2011/0162560 A1 * 7/2011 Tang ..... A47C 3/16 108/11
2011/0272419 A1 * 11/2011 Vanderberg ..... B65D 21/086 220/666
2012/0000912 A1 * 1/2012 Potts ..... A45C 7/0022 220/553
2012/0074823 A1 * 3/2012 Bezich ..... A47B 87/0292 312/240
2013/0080286 A1 * 3/2013 Rotholz ..... A47C 5/005 705/26.5
2013/0264921 A1 * 10/2013 Kumar ..... A47B 85/06 312/235.5
2015/0136766 A1 * 5/2015 Rivas ..... B65F 1/02 220/8
2015/0217901 A1 * 8/2015 Bagley ..... B65D 21/086 220/8
2016/0000226 A1 * 1/2016 Sanza Pilas ..... A47C 4/52 297/4
2016/0059990 A1 * 3/2016 Patikas-Bryant .... B65D 21/086 220/523
2016/0068306 A1 * 3/2016 Heinz ..... B65D 21/086 220/560.01
2016/0255962 A1 * 9/2016 Tang ..... A47C 7/48
2016/0288955 A1 * 10/2016 Wang ..... B65D 15/22
2017/0029163 A1 * 2/2017 Olds ..... B65D 11/1846
2017/0105535 A1 * 4/2017 Tang ..... A47C 4/02
2017/0238502 A1 * 8/2017 Estrup ..... A01K 1/0254
2017/0334603 A1 * 11/2017 Zaremski ..... B65D 37/00
2017/0347800 A1 * 12/2017 Tang ..... A47C 4/283
2018/0170620 A1 * 6/2018 Brignola ..... B65D 21/0212
2019/0061991 A1 * 2/2019 Woodruff ..... B65D 5/3628
2019/0092525 A1 * 3/2019 Sawachi ..... B65D 21/086

* cited by examiner

FOLDING STORAGE STOOL

CROSS-REFERENCE TO RELATED APPLICATIONS

This application is a continuation of International Patent Application No. PCT/CN2016/088354 with a filing date of Jul. 4, 2016, designating the United States, now pending, and further claims priority to Chinese Patent Application No. 201620525200.3 with a filing date of Jun. 1, 2016. The content of the aforementioned applications, including any intervening amendments thereto, are incorporated herein by reference.

TECHNICAL FIELD

The present invention relates to a folding storage stool.

BACKGROUND OF THE PRESENT INVENTION

At present, in the field of household stools, most of existing stools cannot be folded, and very few folding stools are realized by connecting stool surfaces and stool legs through hinges. However, the stools after folded still have large volumes, and occupy larger floor spaces particularly in height and length directions, so the folding stools are not suitable for use, carrying and storage in families with smaller household spaces. Meanwhile, the existing folding stools have no storage function, and cannot meet the need of household storage.

SUMMARY OF PRESENT INVENTION

A technical problem to be solved by the present invention is to provide a folding storage stool. The folding stool after folded has small volume, is convenient in carrying and placement, and also has a storage function.

To solve the above problem, the present invention adopts the following solution:

A folding storage stool comprises a folding stool body. After the stool body is unfolded, a stool cover is sleeved on an upper opening of the stool body. A supporting board for supporting the stool body is installed at a bottom of an inner cavity of the unfolded stool body. The stool cover has a folding structure capable of being folded and comprises a plurality of sections of cover parts connected mutually and folded relatively. After the cover parts located at an end part are upwards folded, part of the upper opening of the stool body is exposed to form a picking and placing opening.

As a further improvement on the above technical solution:

A supporting back board is installed at an inner side surface of one side wall of the stool body. The supporting back board comprises two sections which can be folded relatively, i.e., a side supporting section and an upper supporting section. The side supporting section is tightly close to the inner wall of the stool body, and the upper supporting section is upwards folded relative to the side supporting section and then abutted against the upwards folded cover parts to obliquely support the cover parts to form a back cushion.

The folding storage stool comprises two cover parts, i.e., a first cover part and a second cover part; upper surfaces of the first cover part and the second cover part are connected into a whole through surface fabric; and the first cover part and the second cover part can be turned by 180°.

Two opposite side surfaces on the stool body have an inwards folded side fold; a bottom surface of the stool body has an inwards folded bottom fold; after the stool body is folded along the side fold and the bottom fold, two other side surfaces of the stool body are closed; and the folded stool body can be placed in the stool cover.

The present invention has technical effects that:

The folding stool of the present invention can be used as a stool, can also be used for storing articles, and is high in practicality and convenient in use. Since the folding stool has a folding function, the folding stool after folded is small in space occupation and convenient in carrying and placement. After the folding stool cover is folded, a picking and placing opening convenient for picking the articles is formed, thereby realizing convenient use. The folded stool cover is combined with the supporting back board installed in the stool body to form a backrest cushion, so that the stool can be converted into a chair for use. The present invention has the characteristics of simple and novel structure and high practicality, is convenient for popularization and application, and has a wide market prospect.

In the figures: 1—stool body; 101—picking and placing opening; 102—side fold; 103—bottom fold; 2—stool cover; 201—cover part; 2011—first cover part; 2012—second cover part; 3—supporting board; 4—supporting back board; 41—side supporting section; and 42—upper supporting section.

DETAILED DESCRIPTION OF PREFERRED EMBODIMENTS

Specific embodiments of the present invention will be further described below in combination with drawings.

Figure 1:
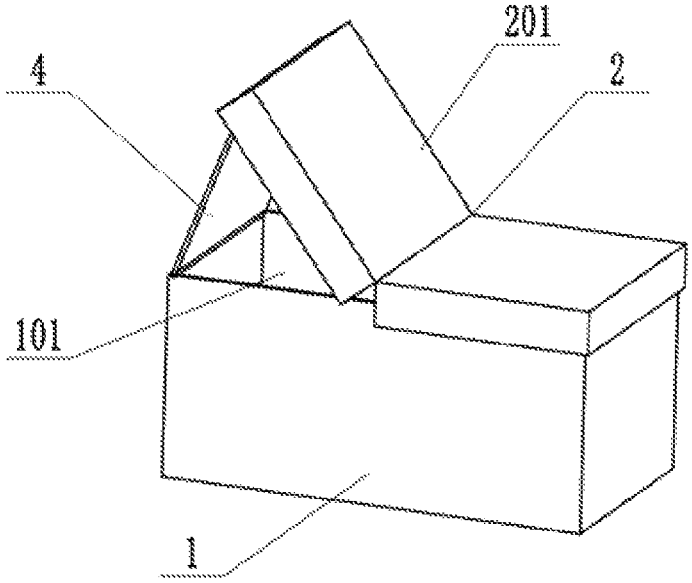
FIG. 1 is a use state diagram of the present invention.
Figure 2:
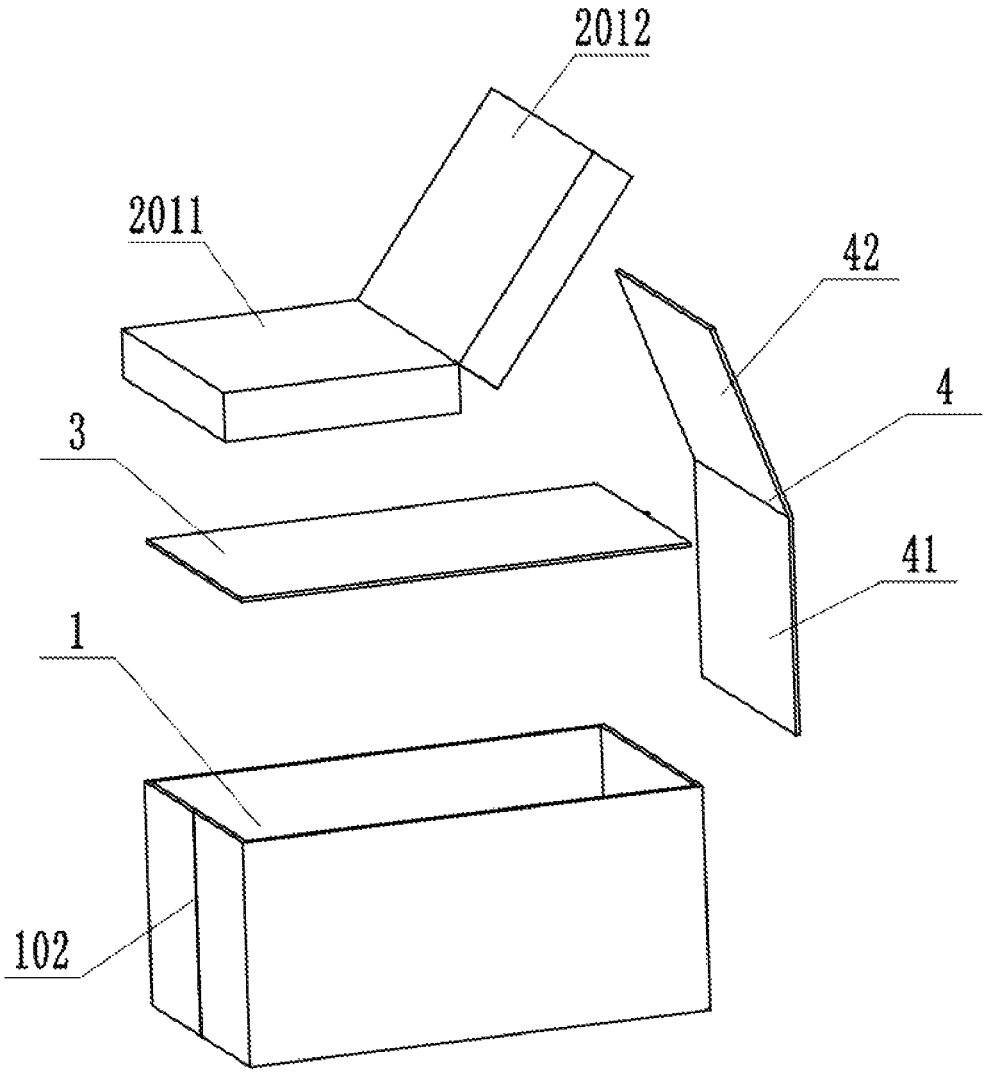
FIG. 2 is an exploded state diagram of the present invention.

As shown in FIG. 1 and FIG. 2, the folding storage stool in the present embodiment comprises a folding stool body 1. After the stool body 1 is unfolded, a stool cover 2 is sleeved on an upper opening of the stool body 1. A supporting board 3 for supporting the stool body 1 is installed at a bottom of an inner cavity of the unfolded stool body 1. The stool cover 2 has a folding structure capable of being folded and comprises a plurality of sections of cover parts 201 connected mutually and folded relatively. After the cover parts 201 located at an end part are upwards folded, part of the upper opening of the stool body 1 is exposed to form a picking and placing opening 101. Generally, two cover parts 201 are arranged, i.e., a first cover part 2011 and a second cover part 2012. Upper surfaces of the first cover part 2011 and the second cover part 2012 are connected into a whole through surface fabric. The first cover part 2011 and the second cover part 2012 can be turned by 180°.

As shown in FIG. 1 and FIG. 2, a supporting back board 4 is installed at an inner side surface of one side wall of the stool body 1. The supporting back board 4 comprises two sections which can be folded relatively, i.e., a side supporting section 41 and an upper supporting section 42. The side supporting section 41 is tightly close to the inner wall of the stool body 1. The upper supporting section 42 is upwards folded relative to the side supporting section 41 and then abutted against the upwards folded cover parts 201 to obliquely support the cover parts 201 to form a back cushion.

Figure 3:
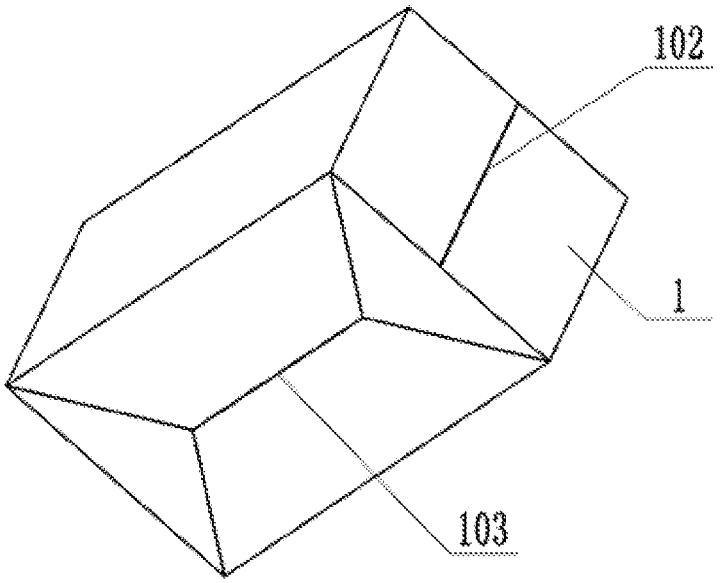
FIG. 3 is a stereoscopic structural diagram of a stool body in the present invention.
Figure 4:
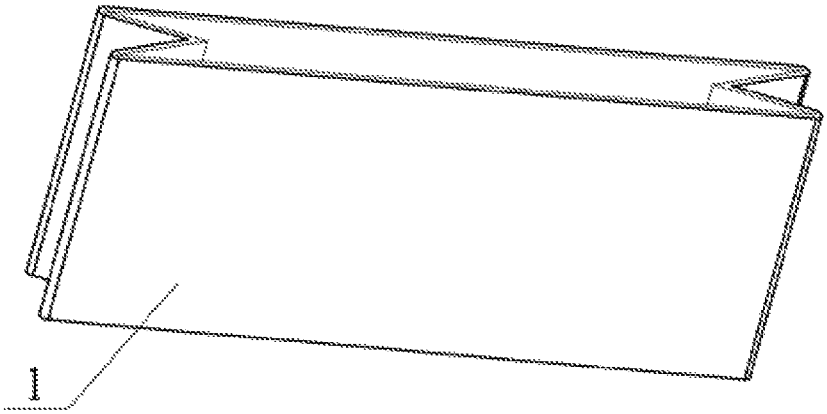
FIG. 4 is a state diagram of a folded stool body in the present invention.

As shown in FIG. 3 and FIG. 4, two opposite side surfaces on the stool body 1 have an inwards folded side fold 102; and a bottom surface of the stool body 1 has an inwards folded bottom fold 103. After the stool body 1 is folded along the side fold 102 and the bottom fold 103, two other side surfaces of the stool body 1 are closed; and the folded stool body 1 can be placed in the stool cover 2.

During use, the stool body 1 is unfolded and the supporting board 3 is placed at the bottom of the inner cavity of the stool body 1 to ensure that the stool body 1 is completely unfolded. The stool cover 2 is covered at the opening after the stool body 1 is unfolded. The cover parts 201 at one end are folded and the formed picking and placing opening 101 can be used for directly picking and placing the articles. The cover parts 201 are folded so that the cover parts 201 are in an oblique state. The supporting back board 4 after upwards folded is abutted against the cover parts 201. The oblique cover parts 201 are in a shape of a backrest, so as to support a human back.

Embodiments cited above are preferred embodiments of the present invention, and are only used for facilitating description of the present invention, not for making any formal limitation to the present invention. For those skilled in the art, equivalent embodiments partially changed or modified by using technical contents disclosed in the present invention without departing from a scope of technical features proposed in the present invention and without departing from contents of the technical features of the present invention still belong to a scope of the technical features of the present invention.

I claim:

1. A foldable stool, comprising a foldable stool body;

a stool cover; and a supporting board;

wherein the foldable stool body comprises an inner cavity and an upper opening;

the upper opening allows the inner cavity to be in communication with an outside;

the stool cover is located upon the foldable stool body and covers the upper opening;

the supporting board is located at a bottom of the inner cavity and supports the foldable stool body to maintain an unfolded state;

the stool cover comprises a first cover part and a second cover part; wherein a pivot end of the first cover part is pivotably connected to the second cover part, and a free end of the first cover part is capable of being pivotable away from the upper opening;

the foldable stool body further comprises a supporting back board, the supporting back board comprising a side supporting section and an upper supporting section; the upper supporting section is pivotably connected to a connection end of the side supporting section; the side supporting section is attached to an inner surface of the inner cavity; a free end of the upper supporting section is adjacent to the free end of the first cover part and is exterior to the inner cavity; the upper supporting section is capable of pivoting around the connection end of the side supporting section; the first cover part is configured to pivot away from the upper opening, the upper supporting section is configured to pivot outwardly to support the free end of the first cover part at a fixed angle to form a slant back cushion for the foldable stool body.

2. The foldable stool according to claim 1, wherein each of two opposite side surfaces on the foldable stool body comprises an inwardly foldable side fold; a bottom surface of the foldable stool body comprises an inwardly foldable bottom fold; the foldable stool body is capable of being folded along the inwardly foldable side folds and the inwardly foldable bottom fold.

* * * * *